United States Patent [19]

Hill

[11] Patent Number: 4,967,434

[45] Date of Patent: Nov. 6, 1990

[54] BEDDING ANCHORING DEVICE

[76] Inventor: James D. Hill, Box 4823, Santa Barbara, Calif. 93140

[21] Appl. No.: 361,482

[22] Filed: Jun. 5, 1989

[51] Int. Cl.[5] ..... A44B 21/00

[52] U.S. Cl. ..... 5/508; 24/72.5

[58] Field of Search ..... 5/508, 496, 498; 24/72.5

[56] References Cited

U.S. PATENT DOCUMENTS

| | | | |
|---|---|---|---|
| 1,545,501 | 7/1925 | Laird | 24/72.5 |
| 3,962,757 | 6/1976 | Gedney | 24/72.5 |
| 4,400,836 | 8/1983 | Pelura | 5/498 |
| 4,520,518 | 6/1985 | Reaser | 5/508 |
| 4,521,970 | 6/1985 | Tester | 5/508 |
| 4,635,308 | 1/1987 | Maggio | 5/508 |
| 4,794,660 | 1/1989 | Hawkrigg | 5/498 |

FOREIGN PATENT DOCUMENTS

| | | | |
|---|---|---|---|
| 2228156 | 12/1973 | Fed. Rep. of Germany | 24/72.5 |

*Primary Examiner*—Gary L. Smith
*Assistant Examiner*—Flemming Saether
*Attorney, Agent, or Firm*—Robert M. Sperry

[57] ABSTRACT

Improved bedding anchoring means comprising a generally rectangular or pentagonal sheet of rigid or semi-rigid material formed with an opening for receiving a portion of a sheet corner therethrough and having locking means for preventing inadvertent removal of the sheet corner from the anchoring device.

7 Claims, 2 Drawing Sheets

BEDDING ANCHORING DEVICE

BACKGROUND

1. Field of Invention

This invention relates to bedding and is particularly directed to anchoring means for maintaining bedding, such as sheets, blankets and the like, properly tucked under the mattress of a bed or waterbed.

2. Prior Art

The conventional manner of making a bed is to spread a bottom sheet over a bed and to tuck all of the edges of the sheet under the adjacent edges of the mattress or to use a fitted sheet, which is an additional expense, and, subsequently, to spread a top sheet over the bed and to tuck the bottom edge of the top sheet under the bottom of the mattress. Blankets and spreads or coverlets are often tucked in also. Unfortunately, when the bed is used, the person using the bed often tugs at the bedding to pull it closer about their shoulders and, in doing so, dislodges the bedding from under the mattress with the result that the person becomes cold and is exposed to the night air. Also, the movement of the person can dislodge the lower sheet, causing it to wrinkle or expose the mattress. This is extremely annoying to many persons and may serve to awaken them and, hence, to interrupt their sleep, causing them to be drowsy and irritable the next day.

Numerous devices have been proposed heretofore to overcome these problems. However, many of the prior art anchoring device have been visible and, hence, have detracted from the appearance of the bed. Other prior art sheet anchoring devices have required modification of the sheets and have not been useful with standard sheets. Still other prior art sheet anchoring devices have been bulky and have formed lumps in the bedding, when in use, which are uncomfortable for the sleeper's feet. Still other prior art bedding anchoring devices have failed to adequately prevent the bedding from pulling loose. A search in the United States Patent Office has revealed the following patents:

| U.S. Pat. No. | INVENTOR | ISSUED |
|---|---|---|
| 4,276,667 | B. C. Osbourne | July 7, 1981 |
| 4,520,518 | B. K. Reaser | June 4, 1985 |
| 4,400,836 | C. F. Pelura | Aug. 30, 1983 |
| 4,635,308 | C. F. Maggio et al | Jan. 13, 1987 |
| 4,646,375 | R. W. Parker | Mar. 3, 1987 |
| 4,651,371 | B. K. Hahn | Mar. 24, 1987 |
| 4,773,108 | T. P. Leever | Sep. 27, 1988 |
| 4,782,543 | W. B. Hutton et al | Nov. 8, 1988 |

Each of these references is subject to one or more of the objections noted above. Thus, none of the prior art sheet anchoring devices have been entirely satisfactory.

BRIEF SUMMARY AND OBJECTS OF THE INVENTION

These disadvantages of prior art bedding anchoring devices are overcome with the present invention and a bedding anchoring device is provided which is inconspicuous when in use an which fits smoothly under the mattress without causing uncomfortable lumps, yet which firmly locks the bedding corner in the desired position so as to positively preclude inadvertent dislodging of the sheets and blankets at the corners of the mattress.

The advantages of the present invention are preferably attained by providing an improved bedding anchoring device comprising a generally rectangular or pentagonal sheet of rigid or semirigid material formed with an opening for receiving a portion of a sheet corner therethrough and having locking means for preventing inadvertent removal of the sheet corner from the anchoring device.

Accordingly, it is an object of the present invention to provide improved anchoring means for bedding, such as sheets, blankets and the like.

Another object of the present invention is to provide improved sheet anchoring means which is inconspicuous when in use.

An additional object of the present invention is to provide improved bedding anchoring means which securely locks the bedding in place without damaging the bedding.

Another object of the present invention is to provide improved bedding anchoring means which securely locks the bedding in place without causing wear to the bedding.

A further object of the present invention is to provide improved sheet anchoring means which does not create uncomfortable lumps in the bedding when in use.

An additional object of the present invention is to provide improved sheet anchoring means which positively precludes inadvertent dislodging of the corner of the sheet.

A specific object of the present invention is to provide improved sheet anchoring means comprising a generally pentagonal sheet of rigid or semi-rigid material formed with an opening for receiving a portion of a sheet corner therethrough and having locking means for preventing inadvertent removal of the sheet corner from the anchoring device.

These and other objects and features of the present invention will be apparent from the following detailed description, taken with reference to the figures of the accompanying drawings.

DETAILED DESCRIPTION OF THE INVENTION

Figure 1:
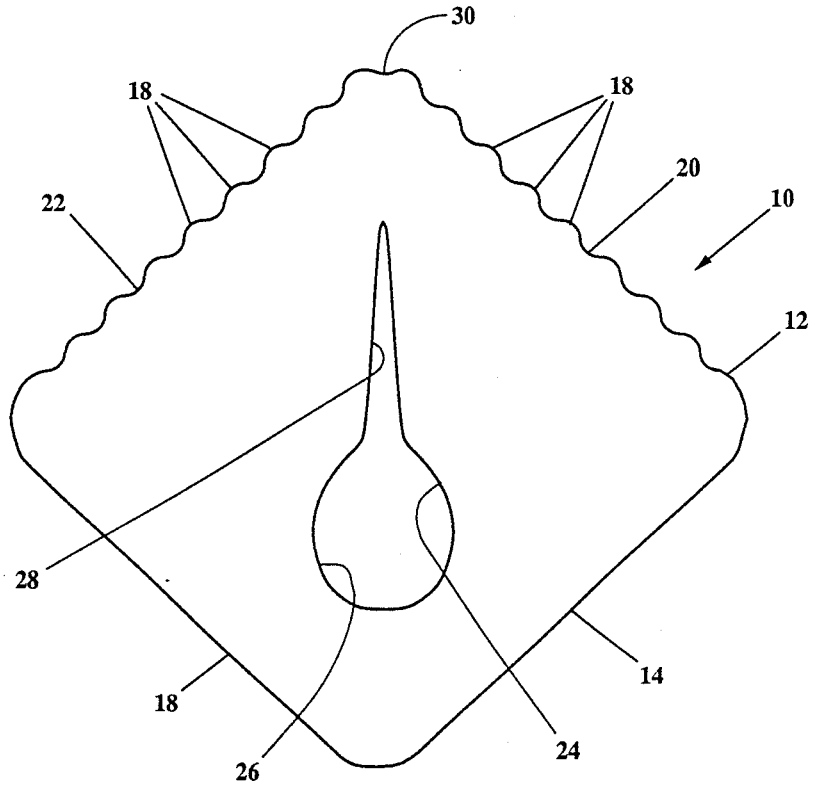
FIG. 1 is a plan view of a bedding anchor embodying the present invention.

In that form of the present invention chosen for purposes of illustration in the drawing, FIG. 1 shows a bedding anchor, indicated generally at 10, comprising a flat sheet 12 of rigid or semi-rigid material having a generally rectangular configuration with two relatively straight aides 14 and 16 and two sides 20 and 22 formed with a plurality of corrugations, as seen at 18. Although the corrugations 18 may, if desired, be omitted, it has been found that the corrugations 18 serve to prevent the corner portion of the bedding from becoming bunched and aids in preventing dislodging of the bedding anchor 10 and the bedding retained thereby. A generally tear-shaped opening 24 is formed generally centrally of the sheet 12 and has a generally circular portion 26 with a tapered portion 28 extending from the generally circular portion 24 toward the juncture 30 between the two corrugated sides 20 and 22.

Figure 2:
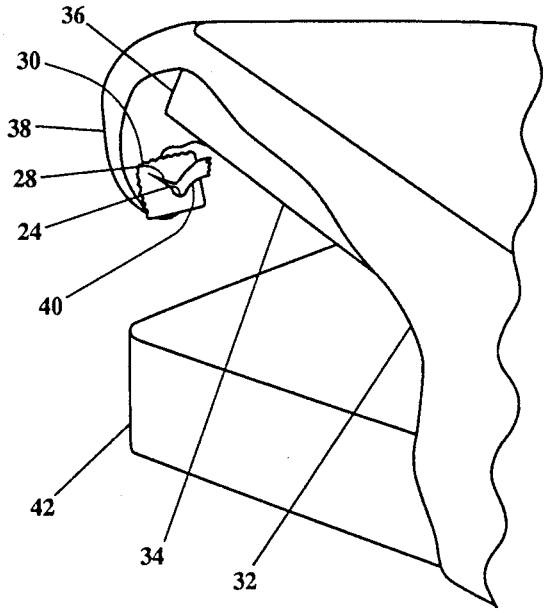
FIG. 2 is an isometric view showing the bedding anchor of FIG. 1 during installation.

In use, as best seen in FIG. 2, a bedsheet 32 is spread over a mattress 34 and one corner 36 of the foot of the mattress 34 is raised and the corner 38 of the sheet 32 is draped over the corner 36 of the mattress 34. The sheet anchor 10 is placed under the sheet 32 with the juncture 30 facing in a direction corresponding with that of the corner 36 of the mattress 34. Next, the tip 40 of the corner 38 of the sheet 32 is inserted upward through the opening 24 of the sheet anchor 10 and is pulled toward the juncture 30 to cause the tip 40 of the bed sheet 32 to wedge into the tapered portion 28 of the opening 24. The sheet anchor 10 is then placed on the bed stead 42 overlying the corner 38 of the sheet 32 and the corner 36 of the mattress 34 is placed on top of the sheet anchor 10. Obviously, this procedure should be repeated at each corner of the mattress 34 where the bedding is to be anchored. Thereafter, the user may proceed to make the bed in the usual manner. Subsequently, when someone uses the bed, tugging on the sheet 32 will only serve to wedge the tip 40 more firmly into the tapered portion 28 of the opening 24 of the sheet anchor 10, while the weight of the mattress 34 and the wrapping of the bedding from under the corrugated sides of the anchor and around the adjacent corner 36 of the mattress 34 will serve to retain the sheet anchor 10 in position and will positively preclude inadvertent dislocation of the corner 38 of the sheet 32. It should be noted that, when the corner 40 of the sheet 32 is drawn through the opening 24 and is wedged into the tapered portion 28, the bedding anchor 10 is then positioned to overlie the corner of the sheet 32 so that the corner portion 40 of the sheet 32 is compressed between the mattress 34 and the bedding anchor 10, while the bedding anchor 10 is compressed between the mattress and the remainder of the sheet 32. Thus, it is virtually impossible to unintentionally pull the sheet 32 out from under the end of the mattress. To remove the bedding anchor 10, one simply raises the corner 36 of the mattress 34, retrieves the bedding anchor 10 and pulls the tip 40 of the sheet 32 rearwardly toward the circular portion 26 of the opening 24 to release the tip 40 of the sheet 32 from the tapered portion 28 of the opening 24. The bedding anchor 10 may then be removed from the tip 40 of the sheet 32 for storage or use with another sheet.

Figure 3:
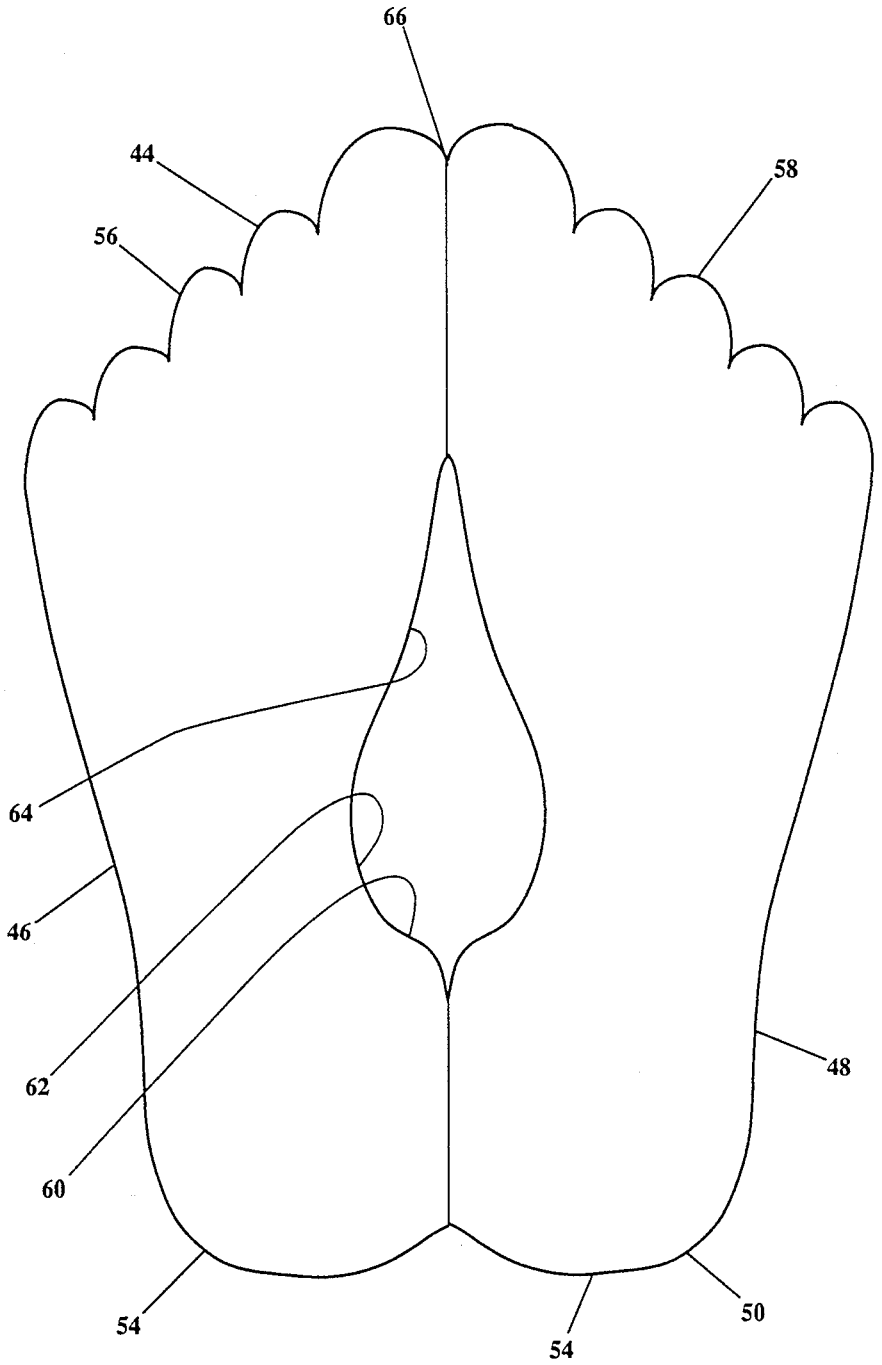
FIG. 3 is a view, similar to that of FIG. 1, showing an alternative form of the bedding anchor of FIG. 1.

FIG. 3 shows a modified form of the bedding anchor of the present invention. In this form of the present invention, the sheet anchor 44 is formed generally pentagonal and is made to simulate a pair of feet with sides 46 and 48 tapering slightly inwardly toward the rear side 50. Side 50 is formed in a pair of curves 52 and 54, corresponding to the shape of a pair of heels, and the corrugated front sides 56 and 58 are formed to simulate toes. As with the form of FIG. 1, a central opening 60 is provided having a relatively wide rear portion 62 and a tapered forward portion 64 extending toward the juncture 66 between the corrugated sides 56 and 58. This form of the present invention is used in the same manner as described above for the sheet anchor 10 of FIG. 1.

Obviously, numerous other variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A bedding anchor comprising:

a sheet of material having two adjacent corrugated sides forming approximately a 90° angle, and a locking means comprising an opening formed in said sheet having a tapered portion extending toward the juncture of said two sides of said sheet for receiving and anchoring a portion of a bedding corner.

2. The bedding anchor of claim 1 wherein:

said sheet of material has at least two generally straight sides and two adjacent corrugated sides.

3. The bedding anchor of claim 1 wherein: said sheet of material is generally rectangular.

4. The bedding anchor of claim 1 wherein: said sheet of material is generally pentagonal.

5. The bedding anchor of claim 4 wherein:

said sheet of material is shaped to correspond to the shape of a pair of human feet, having two sides tapering toward a rear side which is formed with a pair of curves simulating the heels of a pair of feet and having two adjacent front sides corrugated to simulate the toes of said foot.

6. A bedding anchor comprising:

a sheet of material having at least two generally straight sides and two adjacent corrugated sides and formed with an opening for receiving a portion of a bedding corner, and locking means comprising a portion of said opening tapered towards the juncture of said corrugated sides for preventing inadvertent removal of said bedding corner from said opening.

7. A bedding anchor comprising:

a generally pentagonal sheet of material shaped to correspond to the shape of a pair of human feet, having two sides tapering toward a rear side which is formed with a pair of curves simulating the heels of a pair of feet and having two adjacent front sides with corrugations to simulate the toes of said foot, said sheet being formed with an opening for receiving a portion of a bedding corner, and locking means comprising a portion of said opening tapered towards the juncture of said corrugated sides for preventing inadvertent removal of said bedding corner from said opening.

* * * * *